US009079070B2

(12) United States Patent
Reynolds et al.

(10) Patent No.: US 9,079,070 B2
(45) Date of Patent: Jul. 14, 2015

(54) SOFT KETTLEBELL

(75) Inventors: Curt Lawson Reynolds, Tomball, TX (US); Robert Allan Ross, Katy, TX (US)

(73) Assignee: Cap Barbell, Inc., Houston, TX (US)

( * ) Notice: Subject to any disclaimer, the term of this patent is extended or adjusted under 35 U.S.C. 154(b) by 148 days.

(21) Appl. No.: 13/330,151

(22) Filed: Dec. 19, 2011

(65) Prior Publication Data

US 2013/0157815 A1 Jun. 20, 2013

(51) Int. Cl.

| | |
|---|---|
| ***A63B 21/06*** | (2006.01) |
| ***A63B 23/16*** | (2006.01) |
| ***A63B 21/072*** | (2006.01) |
| *A63B 21/00* | (2006.01) |

(52) U.S. Cl.

CPC ..... *A63B 21/072* (2013.01); *A63B 21/0603* (2013.01); *A63B 21/1469* (2013.01); *A63B 2209/10* (2013.01)

(58) Field of Classification Search

USPC ..... 482/44–50, 92, 93, 910, 86, 106–109, 482/111, 112, 908; D21/662, 679

See application file for complete search history.

(56) References Cited

U.S. PATENT DOCUMENTS

| | | | | |
|---|---|---|---|---|
| 4,799,521 | A * | 1/1989 | Shick | 150/107 |
| 5,417,635 | A * | 5/1995 | Sell | 482/105 |
| 2006/0135330 | A1* | 6/2006 | Clark et al. | 482/139 |
| 2007/0087914 | A1 | 4/2007 | Connelly et al. | |
| 2009/0093348 | A1* | 4/2009 | Wang | 482/93 |
| 2010/0178981 | A1* | 7/2010 | Holcomb et al. | 463/37 |
| 2010/0248910 | A1 | 9/2010 | DiLuglio | |
| 2010/0255960 | A1 | 10/2010 | Kessler | |
| 2011/0152042 | A1 | 6/2011 | Anderson | |
| 2011/0275494 | A1* | 11/2011 | Radi et al. | 482/93 |
| 2012/0149536 | A1* | 6/2012 | Trimble et al. | 482/93 |
| 2012/0322627 | A1* | 12/2012 | Emerson | 482/93 |
| 2013/0040789 | A1* | 2/2013 | Kessler | 482/108 |

OTHER PUBLICATIONS

Soft Adjustable X-bag for Kettlebell training;The ultimate in cross training. www.flextrain.net. Mar. 25, 2010.

The Hyperwear Sandbell; www.hyperwear.com. Jan. 17, 2009.

The Packweight Textile Kettlebell; www.packweight.com. Sep. 17, 2007.

U Fill It Kettlebell; www.artofstrength.com. Sep. 26, 2011.

Kettlebell Styles; www.muscledriverusa.com. Jul. 17, 2007.

* cited by examiner

*Primary Examiner* — Loan H Thanh
*Assistant Examiner* — Nyca T Nguyen
(74) *Attorney, Agent, or Firm* — D'Ambrosio & Menon, PLLC; Usha Menon

(57) ABSTRACT

A soft kettlebell and methods for making the soft kettlebell. The soft kettlebell may generally comprise a body, the body having a soft outer shell and an inner weighted fill material, and a handle attached to the body. One or more embodiments of the soft kettlebell may provide for a safer alternative to conventional kettlebells while allowing a user the flexibility of performing similar weight training exercises as with the conventional kettlebells. The soft body of the soft kettlebell may dampen any inadvertent impact against users and surrounding objects if dropped or if loss of control occurs.

13 Claims, 6 Drawing Sheets

SOFT KETTLEBELL

FIELD OF THE INVENTION

The invention relates generally to exercise equipment, and more particularly to kettlebells.

BACKGROUND

Exercise is an activity well known for its physical and mental health benefits. Among the various types of exercises, weight training is a form of strength training that aims to develop the strength and size of skeletal muscles. Weight training utilizes the weight force of gravity acting on physical objects to oppose the force generated by muscle. These physical objects are available in a variety of types of specialized equipment.

One type of equipment used in weight training is the kettlebell. A kettlebell allows the user to combine strength training, cardiovascular fitness and flexibility training to provide a dynamic workout. Kettlebells have traditionally comprised a cast iron weight having a substantially spherical body and a handle integrally attached to the body. Kettlebell workouts typically involve a user lifting the kettlebell by its handle and swinging the kettlebell in a series of movements.

SUMMARY

One or more embodiments of the invention relate to a soft kettlebell. The soft kettlebell may comprise a sealable enclosure formed of a pliable material, and a handle coupled to the enclosure.

The sealable enclosure may be capable of receiving a fill material. The sealable enclosure may be constructed of one or more types of fabric or foam. In one or more embodiments, the sealable enclosure may comprise one or more materials selected from a group consisting of: polyester, polyester nylon, neoprene, leather, cotton, spandex, canvas, and polyurethane foam.

A non-porous bladder may be disposed within at least a portion of the enclosure. The non-porous bladder may be capable of receiving a fill material.

In one or more embodiments, the fill material may comprise at least one of: sand, iron sand, and iron pellets.

In one or more embodiments, the handle may comprise a strap and a sleeve. The strap may have first and second ends coupled to the enclosure, and may be at least partially enclosed by the sleeve. The first and second ends of the strap may be coupled to the enclosure by reinforced stitching. The strap may be constructed of one or more materials selected from a group consisting of: polymer, polyester nylon, neoprene, leather, cotton, spandex, canvas, polyurethane foam, and rope. The sleeve may comprise a thermoplastic. In one or more embodiments, the sleeve may comprise one or more materials selected from a group consisting of: polyvinyl chloride (PVC), thermoplastic elastomers (TPE), thermoplastic rubbers (TPR), and ethylene-vinyl acetate (EVA) foams.

Surface deviations, such as ridges, bumps, and indentations, may be disposed on the sleeve in order to provide a handle with an ergonomic grip.

In one or more embodiments, the handle may further comprise a rigid structure disposed within the enclosure. The rigid structure may have an upper arcuate portion housed within an upper portion of the enclosure, and first and second legs that extend from the upper arcuate portion into a lower portion of the enclosure. Each of the first and second legs may have a rounded end. The rounded ends may prevent the rigid structure from puncturing the enclosure.

The rigid structure may comprise one or more materials selected from a group consisting of: polyvinyl chloride (PVC), acrylonitrile butadiene styrene (ABS) plastic, any thermoplastic, plastic, aluminum, steel, and wood.

The total weight of the soft kettlebell may range from about 5 pounds to about 30 pounds. In one or more embodiments, the weight of the kettlebell may be adjusted using weight adjustment means for opening and re-sealing at least one of: the sealable enclosure and the bladder in order to adjust the weight of the kettlebell by adding or removing fill material. The weight adjustment means may comprise at least one of: one or more flaps, one or more hook-and-loop fasteners, one or more buttons, and one or more zippers. In other embodiments, the bladder may comprise a predetermined amount of fill material and the enclosure may be permanently sealed.

One or more embodiments of the invention relate to a method of manufacturing the soft kettlebell. The method may involve stitching one or more edges of the sealable enclosure, disposing the bladder within the sealable enclosure, inserting the rigid structure through an unstitched bottom portion of the sealable enclosure, and stitching the bottom portion of the sealable enclosure to one or more unstitched edges of the sealable enclosure. The method may further involve filling the bladder with a fill material prior to enclosing the sealable enclosure, the kettlebell having a total weight ranging from about 5 pounds to about 30 pounds.

Inserting the rigid structure may further comprise disposing the rigid structure between the bladder and the sealable enclosure.

DETAILED DESCRIPTION OF THE INVENTION

Figure 1A:
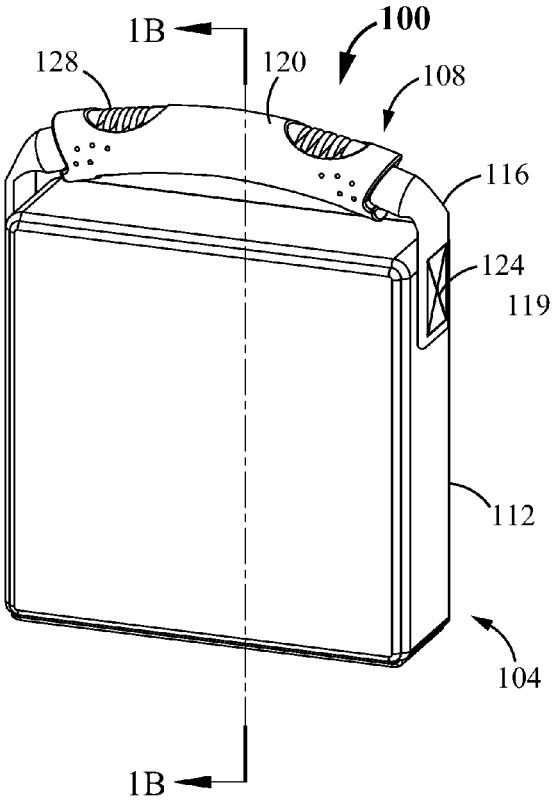
FIG. 1A-1B show a perspective view and a section view, respectively, of a soft kettlebell in accordance with one or more embodiments of the invention.
Figure 1B:
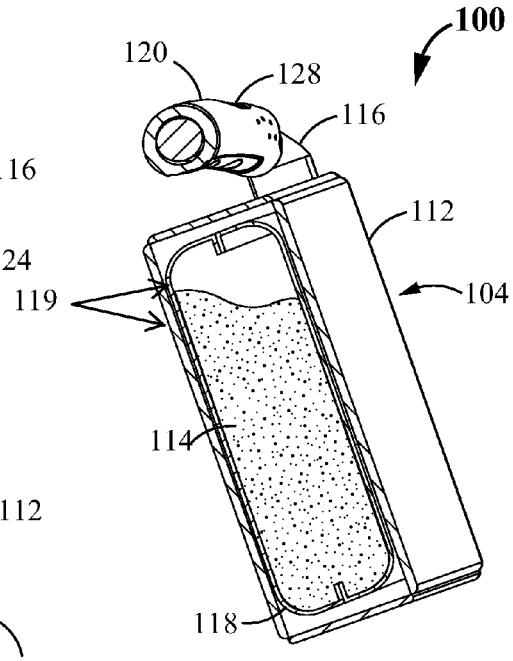
Figure 2C:
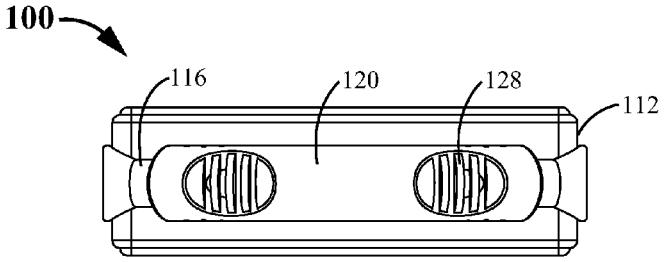
FIGS. 2A-2C show a front view, a side view, and a top view, respectively, of a soft kettlebell in accordance with one or more embodiments of the invention.
Figure 2A:
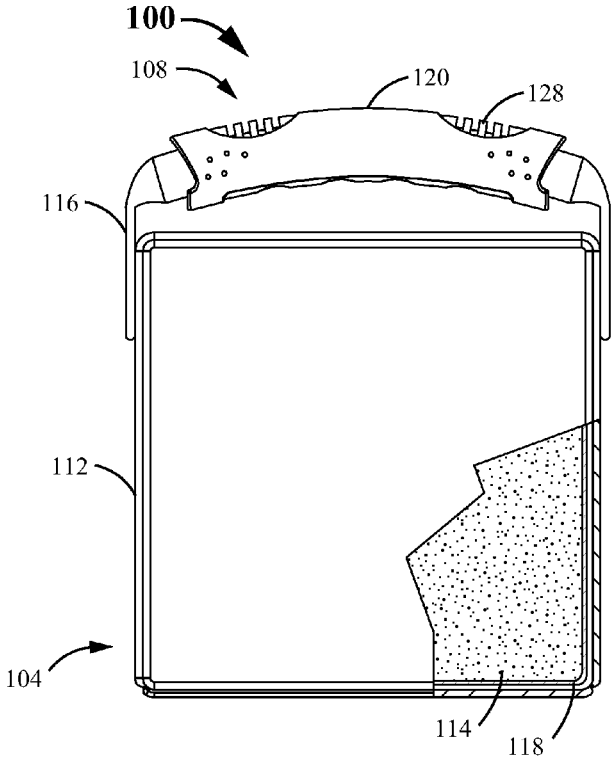
Figure 2B:
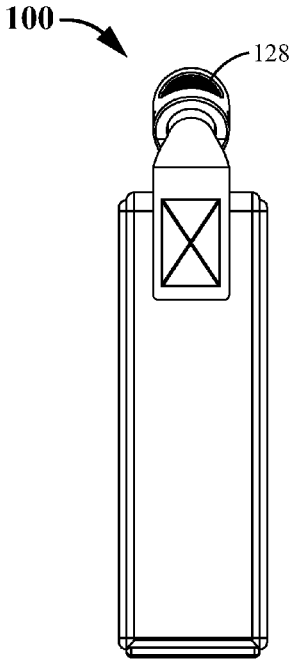
Figure 3A:
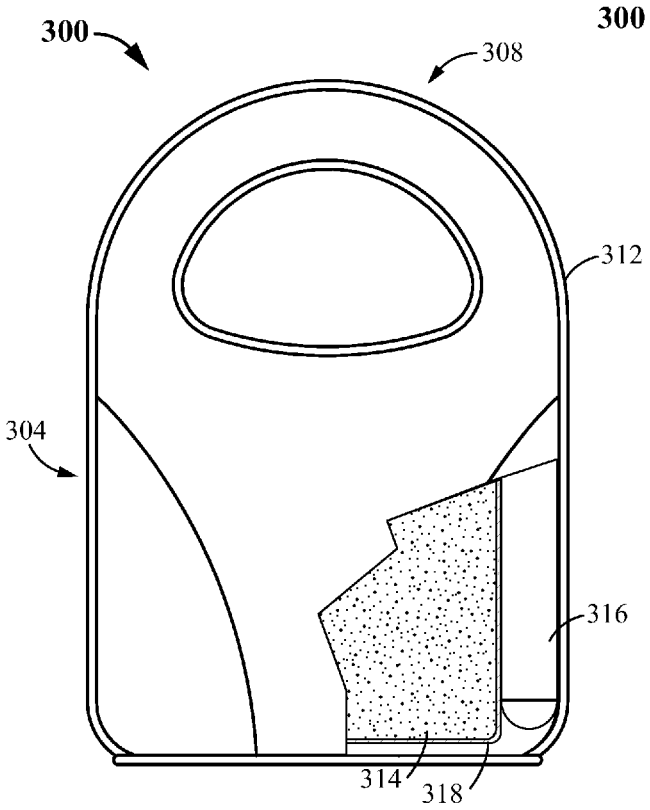
FIGS. 3A-3B show a front view and a side view, respectively of a soft kettlebell in accordance with one or more embodiments of the invention.
Figure 3B:
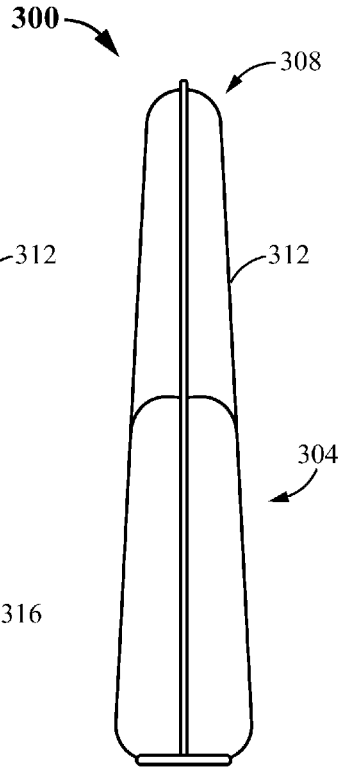
Figure 4A:
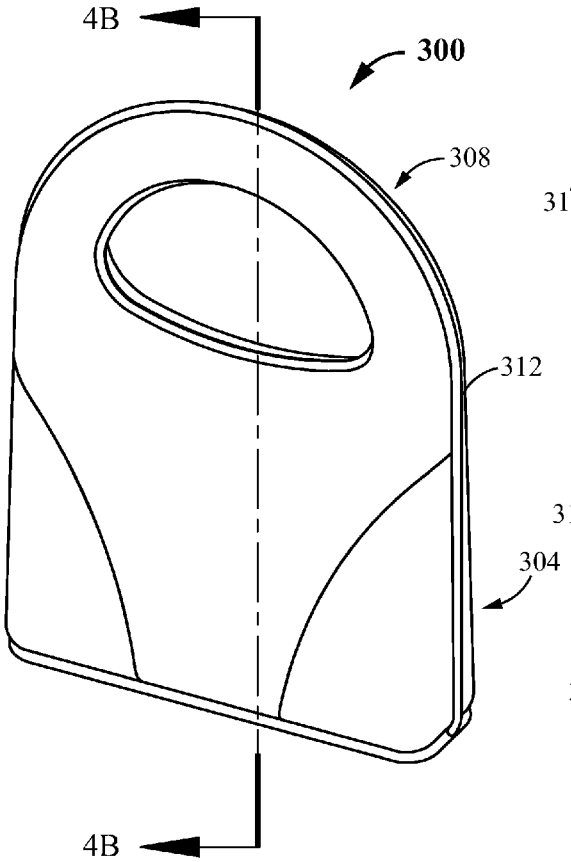
FIGS. 4A-4B show a perspective view and a section view, respectively, of a soft kettlebell in accordance with one or more embodiments of the invention.
Figure 4B:
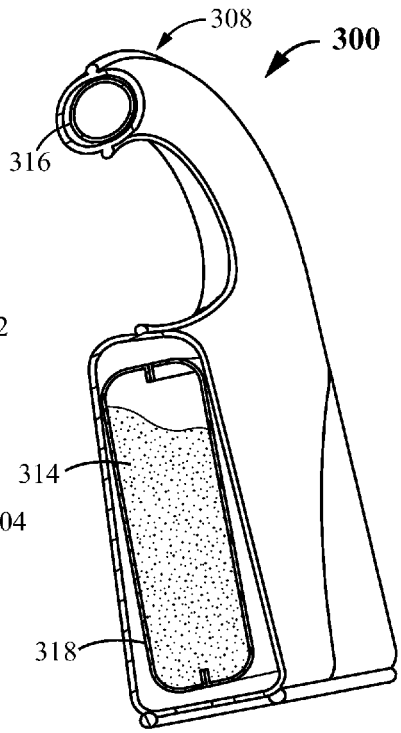

One type of equipment used in weight training is the kettlebell. A kettlebell allows the user to combine strength training, cardiovascular fitness and flexibility training to provide a dynamic workout.

Kettlebells have traditionally comprised a cast iron weight having a substantially spherical body and a handle integrally attached to the body. To complete a kettlebell workout, the user may be required to lift and swing the kettlebell in a series of movements. Because kettlebells are typically heavy and rigid, they may be especially prone to causing injury to a user when dropped. Further, dropping or otherwise losing control of a kettlebell may cause injury to people or damage to objects in the vicinity of the user.

Conventional kettlebells may offer a user little in the way of comfort. Cast iron handles typically lack an ergonomic shape. Some kettlebell users may experience tears to the skin of their hands caused by friction generated doing lifts. Moreover, many cast iron kettlebells lack a textured handle.

Conventional kettlebells may also be bulky, thus requiring more storage space. Paint may peel off from outer surfaces, resulting in the conventional kettlebell's unsightliness and a mess of paint flakes in the vicinity. Because conventional kettlebells are typically made of cast iron, their rigid bottom surface creates instability when placed on uneven surfaces. Further, the manufacture of cast iron kettlebells may result in a considerable amount of pollution.

One or more embodiments of the present invention relate to a soft kettlebell and methods for making the soft kettlebell. The soft kettlebell may generally comprise a body, the body having a soft outer shell and an inner weighted fill material, and a handle attached to the body. One or more embodiments of the soft kettlebell may provide for a safer alternative to conventional kettlebells while allowing a user the flexibility of performing similar weight training exercises as with the conventional kettlebells. The soft body of the soft kettlebell may dampen any inadvertent impact against users and surrounding objects if dropped or if loss of control occurs.

One or more embodiments of the soft kettlebell may provide for a more compact design than conventional kettlebells. Embodiments of the soft kettlebell may comprise a fabric outer shell, avoiding paint peeling issues that may occur with conventional kettlebells. Embodiments of the soft kettlebell may avoid instability on uneven surfaces because their pliant bottom surface may conform to the surface upon which it is placed. Further, embodiments of the soft kettlebell may provide for a cleaner manufacturing process compared to that of conventional kettlebells.

FIGS. 1A-2C illustrate a soft kettlebell 100 in accordance with one or more embodiments of the present invention. The soft kettlebell 100 may comprise a body 104 and a handle 108. The body 104 may comprise a soft outer shell 112, or sealable enclosure formed of a pliable material, packed with an inner weighted fill material 114. A soft fabric or foam may be used to construct the soft outer shell 112. In one or more embodiments, the soft outer shell 112 may be constructed of one or more materials selected from a group consisting of: polyester, polyester nylon, neoprene, leather, cotton, spandex, canvas, and polyurethane foam. However, any material sufficient to securely contain the inner weighted fill material 114 and dampen the soft kettlebell's 100 impact against a person or object may be used to construct the soft outer shell 112.

The inner weighted fill material 114 may be selected from a group consisting of: sand, iron sand, iron pellets, and combinations thereof. However, any material that may be compacted within the soft outer shell 112 to add mass to the body 104 sufficient to facilitate a workout may be used as the inner weighted fill material 114.

In one or more embodiments, the inner weighted fill material 114 may be compacted within an inner bladder 118, the inner bladder 118 enclosed within the soft outer shell 112. The inner bladder 118 may be constructed of a non-porous material to prevent leaking of the fill material 114. For example, in one or more embodiments, the inner bladder 118 may be constructed of a high thread count polyester nylon. The inner bladder 118 may be sealed via reinforced stitching 119 along a perimeter. The inner bladder 118 may further be at least partially attached to the soft outer shell 112 via reinforced stitching 119 along a perimeter.

The body 104 of the soft kettlebell 100 may comprise any three-dimensional shape. In one or more embodiments, the body 104 may comprise a substantially spherical, ellipsoidal, or prismatic shape.

The handle 108 may comprise a strap 116 and a semi-rigid sleeve 120. The ends of the strap 116 may be coupled to the body 104 of the soft kettlebell 100. In one or more embodiments, the ends of the strap 116 may be coupled to the soft outer shell 112 of the kettlebell 100 via reinforced stitching 124. In one or more embodiments, the reinforced stitching 124 may substantially resemble the pattern illustrated in FIG. 1A. Moreover, the reinforced stitching 124 coupling the strap 116 to the body 104 of the soft kettlebell 100 may be disposed at the upper portions of the sides (if body shape is prismatic) of the body 104, as illustrated in FIGS. 1A-2C. In one or more embodiments, the strap 116 may be constructed of one or more materials selected from a group consisting of: nylon, polyester, polyester nylon, neoprene, leather, cotton, spandex, canvas, rope, and polyurethane foam.

The semi-rigid sleeve 120 may partially enclose the strap 116 and be substantially centered along the length of the strap 116. In one or more embodiments, the semi-rigid sleeve 120 may comprise one or more materials selected from a group consisting of: polyvinyl chloride (PVC), thermoplastic elastomers (TPE), thermoplastic rubbers (TPR), and ethylene-vinyl acetate (EVA) foams. The material and shape of the semi-rigid sleeve 120 may be ergonomical, providing a comfortable grip to the user. Surface deviations 128 may be incorporated into the handle 108. The surface deviations 108 may serve as ornamental features, as well as functional elements serving to provide sufficient traction to aid in controlling the soft kettlebell 100, while also providing smooth surfaces that allow the handle to move freely in the user's hand. In one or more embodiments, the surface deviations 108 may be parallel ridges disposed along the top of the semi-rigid sleeve 120, and bumps or indentations disposed along the sides of the semi-rigid sleeve 120, as illustrated in FIGS. 1A-2C.

FIGS. 3A-5B illustrate another embodiment of the soft kettlebell 300. The soft kettlebell 300 may comprise a body 304 and a handle 308. The body 304 may comprise a soft outer shell 312, or sealable enclosure, packed with an inner weighted fill material 314. A soft fabric or foam may be used to construct the soft outer shell 312. In one or more embodiments, the soft outer shell 312 may be constructed of one or more materials selected from a group consisting of: polyester, polyester nylon, neoprene, leather, cotton, spandex, canvas, and polyurethane foam. However, any material sufficient to securely contain the inner weighted fill material 314 and dampen the soft kettlebell's 300 impact against a person or object may be used to construct the soft outer shell 312.

The inner weighted fill material 314 may be selected from a group consisting of: sand, iron sand, iron pellets, and combinations thereof. However, any material that may be compacted within the soft outer shell 312 and add weight to the body 304 sufficient to facilitate a workout may be used as the inner weighted fill material 314.

In one or more embodiments, the inner weighted fill material 314 may be compacted within an inner bladder 318, the inner bladder 318 enclosed within the soft outer shell 312. The inner bladder 318 may be constructed of a non-porous material to prevent leaking of the fill material 314. For example, in one or more embodiments, the inner bladder 318 may be constructed of a high thread count polyester nylon. The inner bladder 318 may be sealed via reinforced stitching 319 along a perimeter. The inner bladder 318 may further be at least partially attached to the soft outer shell 312 via reinforced stitching along a perimeter.

The body 304 of the soft kettlebell 300 may comprise any three-dimensional shape. In one or more embodiments, the body 304 may comprise a substantially spherical, ellipsoidal, or prismatic shape.

Figure 5A:
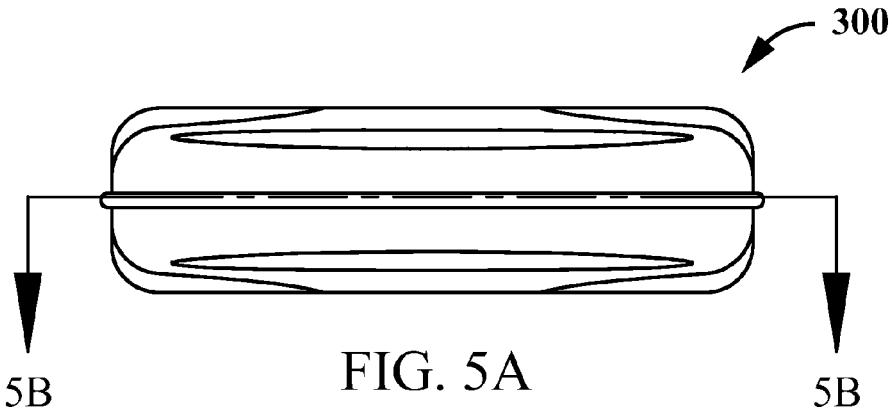
FIGS. 5A-5B show a top view and a section view, respectively, of a soft kettlebell in accordance with one or more embodiments of the invention.
Figure 5B:
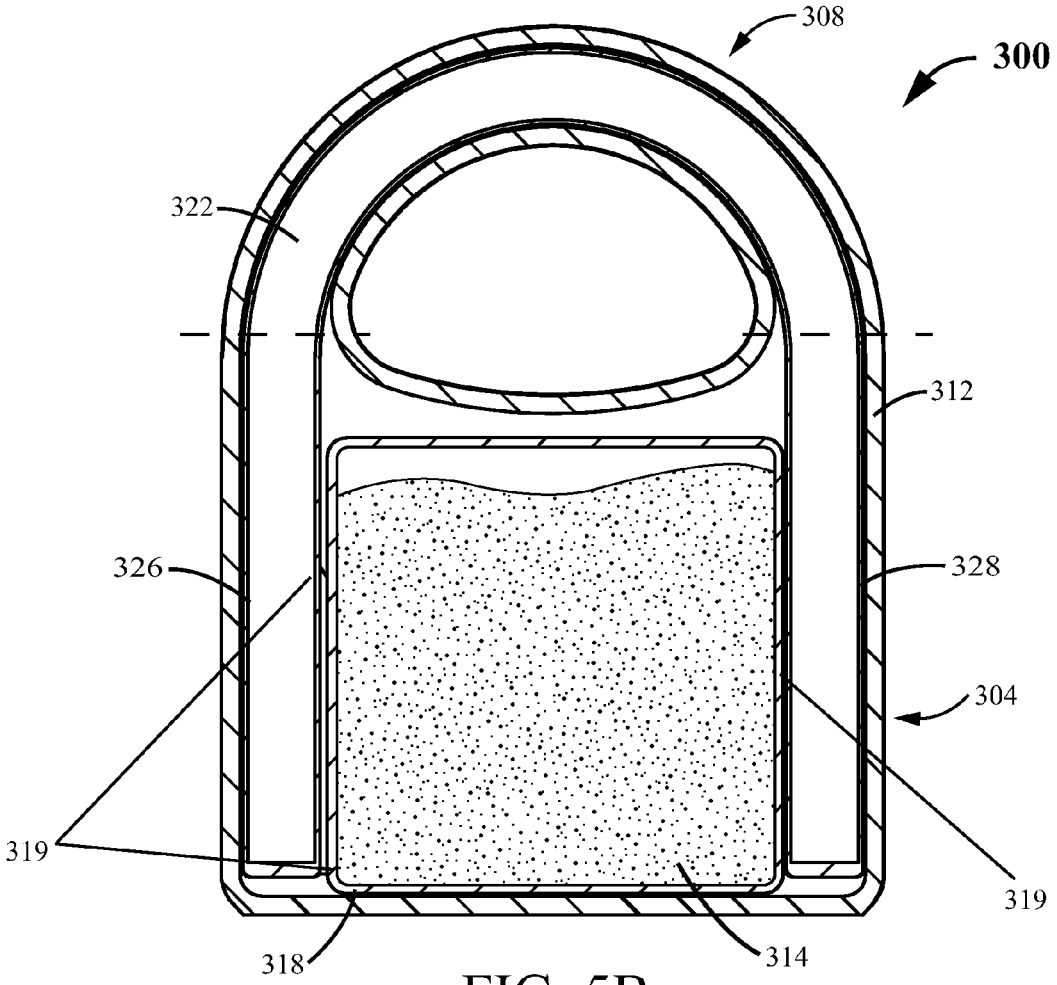

The handle 308 may comprise a rigid structure 316 disposed within the soft outer shell 312. As illustrated in FIG. 5B, the rigid structure 316 may comprise an upper arcuate portion 322 housed within an upper portion of the soft outer shell 312, and first and second legs 326, 328 that extend from the upper arcuate portion 322 into a lower portion of the soft outer shell 312. The first and second legs 326, 328 may each have a rounded end in order to prevent the rigid structure 316 from puncturing the soft outer shell 312. The rigid structure 316 may provide structural support to both the body 304 and the handle 308 of the kettlebell 300. In one or more embodiments, the rigid structure 316 may be constructed of one or more materials selected from a group consisting of: polyvinyl chloride (PVC), acrylonitrile butadiene styrene (ABS) plastic, any thermoplastic, plastic, aluminum, steel, and wood.

In one or more embodiments, the rigid structure 316 may substantially reduce or eliminate the stress concentrations that occur at connection points when a handle is otherwise attached to a kettlebell body.

It is to be understood that reinforced stitching may be used to provide reinforcement along any and all perimeter edges of a soft kettlebell in accordance with the one or more embodiments of the invention. Moreover, in one or more embodiments, a user may be able to vary the weight of a soft kettlebell in accordance with embodiments of the invention. One or more means for adjusting the weight of a soft kettlebell may be used to open and re-seal the body and/or the inner bladder of the soft kettlebell. Means for adjusting the weight of a soft kettlebell may comprise at least one of: one or more flaps, one or more hook-and-loop fasteners, one or more buttons, and one or more zippers. The soft kettlebell may have a maximum weight capacity ranging from about 5 pounds to about 30 pounds.

Figure 6:
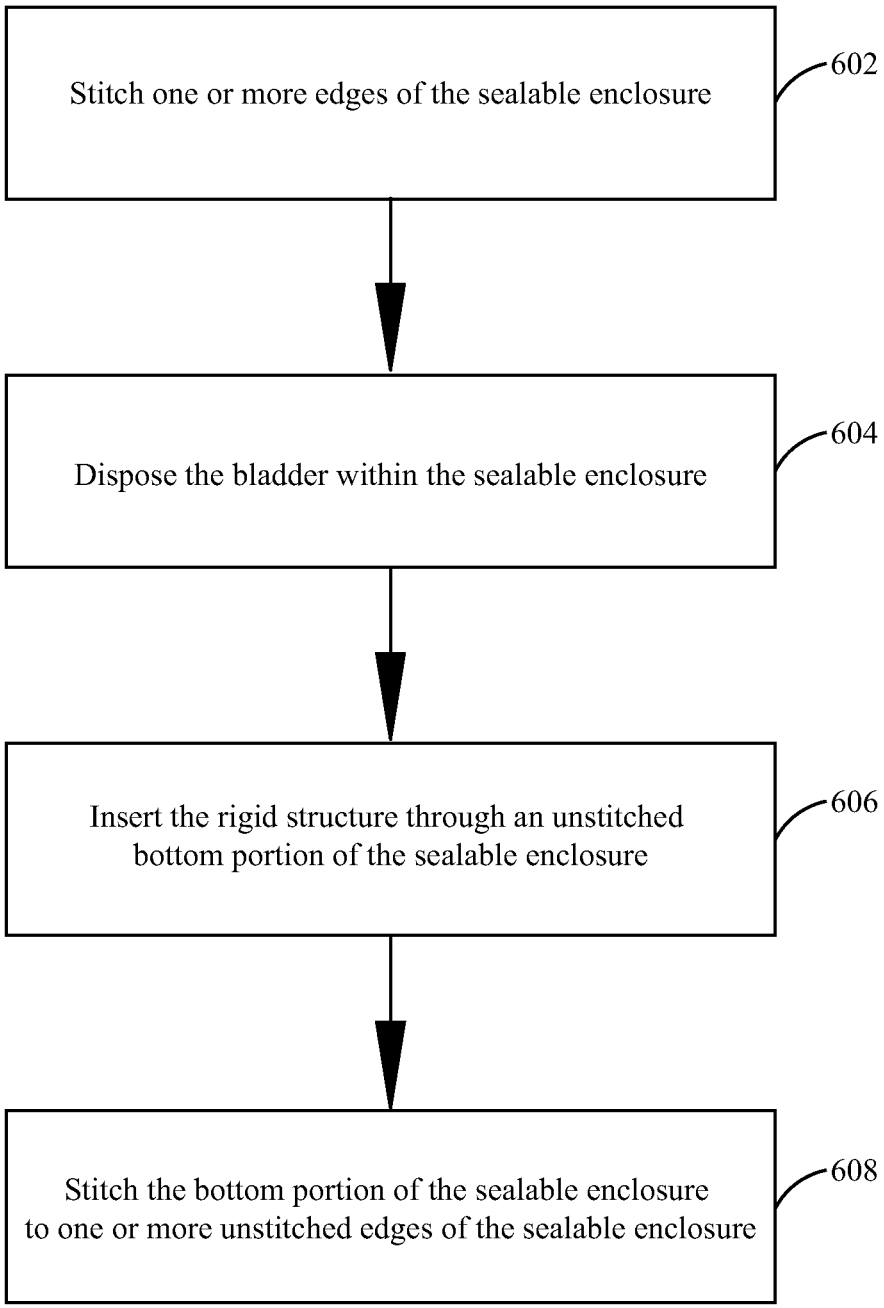
FIG. 6 shows a flow chart illustrating a method of making a soft kettlebell in accordance with one or more embodiments of the invention.

FIG. 6 shows a flow chart illustrating a method of manufacturing a kettlebell in accordance with one or more embodiments of the invention. In step 602 of the method, one or more edges of the soft outer shell, or sealable enclosure, are stitched together using a reinforced stitching pattern.

In step 604 of the method, the inner bladder is disposed within the sealable enclosure. The inner bladder may be filled with a fill material prior to enclosing the sealable enclosure. However, in one or more embodiments, fill material may be provided after the sealable enclosure has been enclosed in order to adjust the weight of the kettlebell. The total weight of the kettlebell may range from about 5 pounds to about 30 pounds.

In step 606 of the method, the rigid structure is inserted through an unstitched bottom portion of the sealable enclosure. Inserting the rigid structure may involve disposing the rigid structure between the bladder and the sealable enclosure.

In step 608, the bottom portion of the sealable enclosure is stitched to one or more unstitched edges of the sealable enclosure.

Accordingly, compared to conventional kettlebells, a soft kettlebell in accordance with one or more embodiments of the invention may provide a user with a safer, more comfortable, and less intimidating experience. The soft kettlebell may further provide for a more compact design than conventional kettlebells. Embodiments of the soft kettlebell may comprise a fabric outer shell, avoiding paint peeling issues that may occur with conventional kettlebells. Embodiments of the soft kettlebell may also avoid instability on uneven surfaces because their pliant bottom surface may conform to the surface upon which it is placed. Further, embodiments of the soft kettlebell may provide for a cleaner manufacturing process compared to that of conventional kettlebells.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The invention claimed is:

1. A kettlebell, comprising:

a fill material, the fill material comprising one or more materials selected from the group consisting of sand, iron sand, and iron pellets;

a soft outer sealable enclosure formed of a pliable material, the soft outer sealable enclosure capable of receiving the fill material;

a sealed non-porous bladder comprising the fill material, the non-porous bladder disposed within at least a portion of the sealable outer enclosure, where in the non-porous bladder is sealed via reinforced stitching along a perimeter of the non-porous bladder, and wherein the non-porous bladder is partially attached to the soft outer sealable enclosure via reinforced stitching of the non-porous bladder directly along a perimeter of the soft outer sealable enclosure; and a handle coupled to the soft outer sealable enclosure.

2. The kettlebell of claim of 1, where in the handle comprises a strap coupled to the sealable enclosure, wherein the strap is partially enclosed within a sleeve, wherein the sleeve is substantially centered along a length of the strap, and wherein the strap comprising first and second ends coupled to the soft outer sealable enclosure via reinforced stitching.

3. The kettlebell of claim 2, the strap comprising one or more materials selected from a group consisting of: polyester, polyester nylon, neoprene, leather, cotton, spandex, canvas, polyurethane foam, and rope.

4. The kettlebell of claim 2, the sleeve comprising one or more materials selected from a group consisting of: polyvinyl chloride (PVC), thermoplastic elastomers (TPE), thermoplastic rubbers (TPR), and ethylene-vinyl acetate (EVA) foams.

5. The kettlebell of claim 2, wherein the sleeve comprises a smooth surface to facilitate free movement of the handle in a user's hand, and wherein the handle further comprises one or more surface deviations to provide traction to aid in controlling the kettlebell, the one or more surface deviations selected from a group consisting of: ridges, bumps, and indentations.

6. The kettlebell of claim 1, the handle comprising: a rigid structure disposed within the enclosure, the rigid structure comprising: an upper arcuate portion housed within an upper portion of the enclosure; and first and second legs that extend from the upper arcuate portion into a lower portion of the enclosure.

7. The kettlebell of claim 6, the rigid structure comprising one or more materials selected from a group consisting of: polyvinyl chloride (PVC), acrylonitrile butadiene styrene (ABS) plastic, any thermoplastic, plastic, aluminum, steel, and wood.

8. The kettlebell of claim 6, each of the first and second legs comprising a rounded end.

9. A method of manufacturing the kettlebell of claim 6, comprising: stitching one or more edges of the sealable enclosure; disposing said non-porous bladder within the sealable enclosure; inserting the rigid structure through an unstitched bottom portion of the sealable enclosure; and stitching the bottom portion of the sealable enclosure to one or more unstitched edges of the sealable enclosure.

10. The method of claim 9, the inserting the rigid structure further comprising disposing the rigid structure between the bladder and the sealable enclosure.

11. The method of claim 9, further comprising filling the bladder with a fill material prior to enclosing the sealable enclosure, the kettlebell comprising a total weight ranging of from about 5 lbs to about 30 lbs.

12. The kettlebell of claim 1, the soft outer sealable enclosure comprising one or more materials selected from a group consisting of: polyester, polyester nylon, neoprene, leather, cotton, spandex, canvas, and polyurethane foam.

13. The kettlebell of claim 1, comprising a total weight ranging from about 5 lbs to about 30 lbs.

* * * * *